US006752589B2

(12) United States Patent
Vogan et al.

(10) Patent No.: US 6,752,589 B2
(45) Date of Patent: Jun. 22, 2004

(54) METHOD AND APPARATUS FOR RETROFITTING A STEAM TURBINE AND A RETROFITTED STEAM TURBINE

(75) Inventors: James Harvey Vogan, Schenectady, NY (US); David Alan Caruso, Ballston Lake, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/270,125

(22) Filed: Oct. 15, 2002

(65) Prior Publication Data

US 2004/0071544 A1 Apr. 15, 2004

(51) Int. Cl.[7] ..... F01D 25/24

(52) U.S. Cl. ..... 415/103; 415/100; 415/912; 29/888.021

(58) Field of Search ..... 415/103, 912, 415/108, 176, 100, 209.2, 107, 99, 102–4, 136; 29/888.021, 888.02, 888

(56) References Cited

U.S. PATENT DOCUMENTS 3,592,557 A * 7/1971 Haas ..... 415/136
3,754,833 A * 8/1973 Remberg ..... 415/108
4,326,832 A * 4/1982 Ikeda et al. ..... 415/219 R
4,362,464 A * 12/1982 Stock ..... 415/136
4,431,371 A * 2/1984 Thomson ..... 415/116
5,388,960 A * 2/1995 Suzuki et al. ..... 415/176
6,305,901 B1 * 10/2001 Bell et al. ..... 415/100

* cited by examiner

*Primary Examiner*—Edward K. Look
*Assistant Examiner*—J. M. McAleenan
(74) *Attorney, Agent, or Firm*—Nixon & Vanderhye

(57) ABSTRACT

A first steam turbine of a reaction stage design is retrofitted to form a second turbine of a substantially impulse stage design using common components with the first turbine. To retrofit the new steam path into the first turbine, the upper outer and inner shells and rotor of the first turbine are removed leaving the lower outer shell. A lower carrier section is installed in the lower outer shell. A lower inner shell forming part of the new steam path is installed on the lower carrier ring. The rotor forming part of the new steam path is installed. The upper inner shell is bolted to the lower inner shell encompassing the rotor and an upper carrier section is bolted to the lower carrier section. Finally, the upper outer shell is bolted to the lower outer shell. Consequently a new steam path of reduced diameter is retrofitted into a prior turbine using the prior turbines outer shell.

11 Claims, 9 Drawing Sheets

METHOD AND APPARATUS FOR RETROFITTING A STEAM TURBINE AND A RETROFITTED STEAM TURBINE

BACKGROUND OF THE INVENTION

The present invention relates to apparatus and methods for retrofitting steam turbines and retrofitted steam turbines. Particularly, the present invention relates to methods for replacing a large-diameter steam path, for example, of a substantially reaction stage design, with a smaller diameter steam path, for example, a substantially impulse stage design, while retaining certain component parts, including the outer shell of the original turbine in the retrofitted turbine.

In steam turbine technology, two distinct steam path designs are prevalent. In reaction stage turbine designs, a portion, for example, about 50% of the stage pressure drop, takes place across the rotating blades, increasing the velocity of the steam and imparting energy to the blades by reaction, as well as momentum exchange. In impulse stage turbine designs, theoretically the entire stage pressure drop is converted into velocity in the nozzles. No pressure drop occurs across the rotating buckets, which change the direction of the steam and absorb energy by momentum exchange.

Wheel and diaphragm-type mechanical constructions are typical in impulse stage design steam paths, whereas a drum-type construction characterizes reaction stage design steam paths. It will be appreciated, however, that an impulse stage design may employ either wheel and diaphragm or drum-type construction. Significantly, improvements in the design and efficiency of steam turbines have resulted in an increase in the root reaction of the impulse stage design without significantly increasing the stage reaction. That is, improved efficiency of the steam turbine has occurred with increased reaction in the impulse stage design but with a reaction level substantially less than a reaction stage design. There are substantial dimensional and design differences in the steam path of this improved impulse stage design, in comparison with the steam path of the reaction stage design. For example, the improved impulse stage design results in a combination of root diameter and length of the bucket less than the corresponding dimensions using a reaction stage design, on the order of about 50% less. Thus, the improved impulse stage design steam path has an inner shell much smaller in diameter than the corresponding diameter of the inner shell of a reaction stage design steam path. The impulse stage design steam path typically has a smaller diameter outer shell as well. Notwithstanding these dimensional and design differences, it is desirable to retrofit steam turbines having existing reaction stage type steam paths with the improved impulse stage design steam path to provide a retrofitted turbine with greater efficiency.

BRIEF DESCRIPTION OF THE INVENTION

In accordance with a preferred embodiment of the present invention, there are provided methods for retrofitting a large diameter steam path, for example, those typified by reaction stage design steam paths with a smaller diameter steam path, for example, those characterized by an improved and more efficient impulse stage steam path design. While it will be appreciated that a smaller diameter rotor and inner shell, characteristic of the improved impulse stage steam path design, replaces corresponding internal parts of the reaction stage steam path design, there has remained the desirability of utilizing the outer shell of the existing turbine with the steam path of the improved impulse design stage as well as other components. That is, to simply replace the steam path of the reaction stage design with the steam path of the improved impulse stage design would undesirably require an inner shell design with long, thick supporting extensions to accommodate the larger outer shell of the extant turbine. The thick extensions would be difficult to cast and might result in excessive thermal stresses during warm-up and cool-down of the retrofitted steam path. Accordingly, the present invention provides an interface between the replacement steam path of the improved impulse stage design and the outer shell of the turbine formerly housing the steam path of the reaction stage design. The interface also allows axial, vertical and radial positioning to be maintained while maintaining inner shell thickness to a minimum to avoid thermal stresses during transient operations.

In order to retrofit a steam path of the reaction stage design with a steam path of an impulse stage design according to a preferred embodiment of the present invention, the inner shell and rotor of the reaction stage design are removed and replaced by an inner shell and rotor of the improved impulse stage design. Because of the gap between the outer shell of the original turbine and the inner shell of the substituted steam path of the impulse stage design, an interface or bridging member is provided between the new inner shell and the old outer shell. Particularly, carrier section or ring halves are interposed between the new inner shell and the original outer shell and enable the reduced diameter steam path for incorporation into the outer shell of the turbine previously having the larger diameter steam path.

In a preferred embodiment according to the present invention, there is provided a method of retrofitting a first steam turbine having an outer shell including a pair of upper and lower outer shell halves and a first steam path of a first diameter in part defined by a first inner shell and a first rotor, to provide a retrofitted second steam turbine, comprising the steps of (a) removing the upper outer shell half, the first inner shell and the first rotor from the lower outer shell half of the first turbine, (b) inserting a lower carrier section into the lower outer shell half, (c) providing a second rotor and a second inner shell in part defining a second steam path of a second diameter smaller than the first diameter of the first steam path, (d) disposing a lower inner shell half of the second inner shell within the lower carrier section, (e) disposing the second rotor into the lower inner shell half of the second inner shell, (f) disposing an upper inner shell half of the second inner shell about the second rotor, (g) disposing an upper carrier section about the upper inner shell half of the second inner shell and (h) securing the upper outer shell half to the lower outer shell half of the first turbine thereby providing a retrofitted second steam turbine having a reduced diameter second steam path.

In a further preferred embodiment according to the present invention, there is provided a method of retrofitting a first steam turbine having a first steam path of a substantially reaction stage design to provide a second turbine having a second steam path of a substantially impulse stage design comprising the steps of (a) removing a first inner shell and a first rotor forming part of the first steam path of the substantially reaction stage first turbine from an outer shell of the first turbine design and (b) placing in the outer shell of the first turbine a steam path having the impulse stage design of the second turbine including a second inner shell and a second rotor, said carrier section being located between the second inner shell and the outer shell of the first turbine to bridge a gap therebetween.

In a further preferred embodiment according to the present invention, there is provided a retrofitted turbine comprising an inner shell surrounding a rotor and defining a steam path, an outer shell surrounding the inner shell and the rotor and a structural bridging member between the inner and outer shells bridging a gap between the shells.

DETAILED DESCRIPTION OF THE INVENTION

Figure 1:
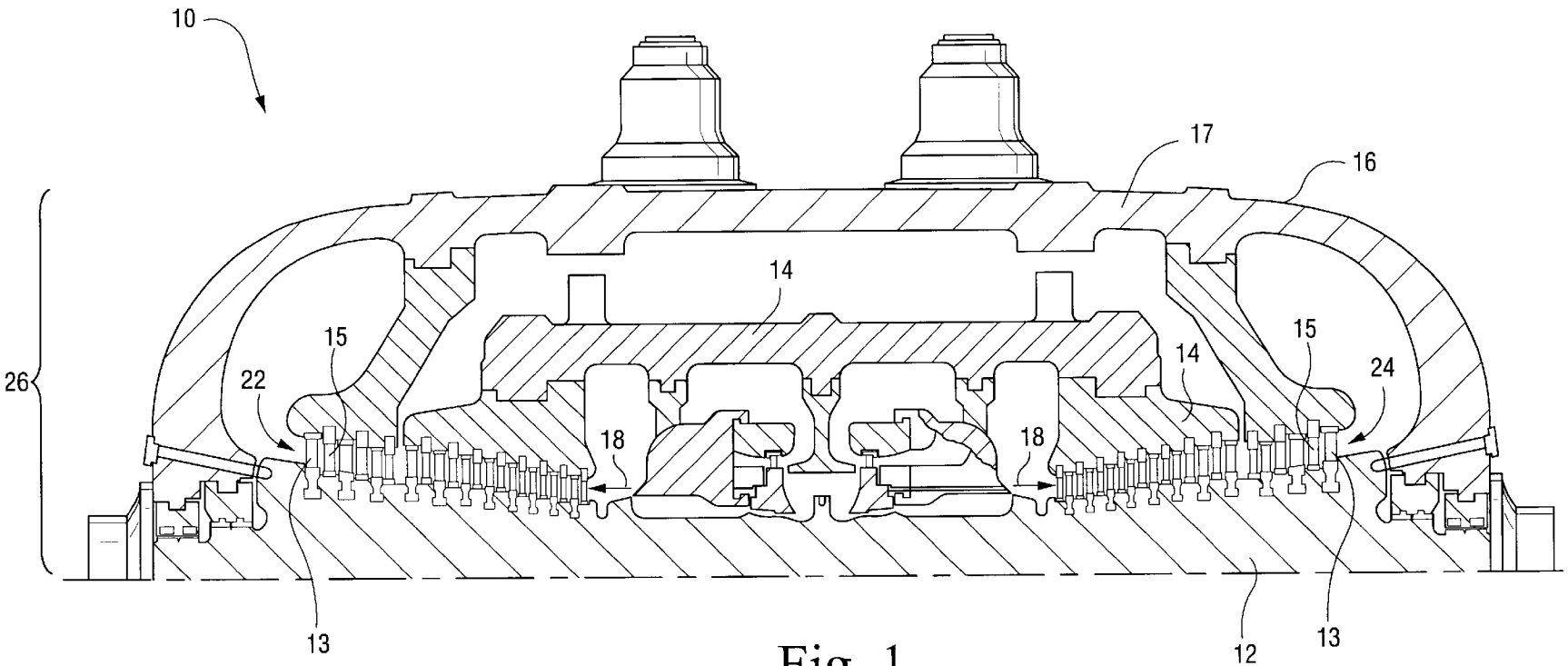
Fig. 1 (Prior Art)
FIG. 1 is a fragmentary cross-sectional view of a portion of double flow steam turbine according to the prior art.
Figure 2:
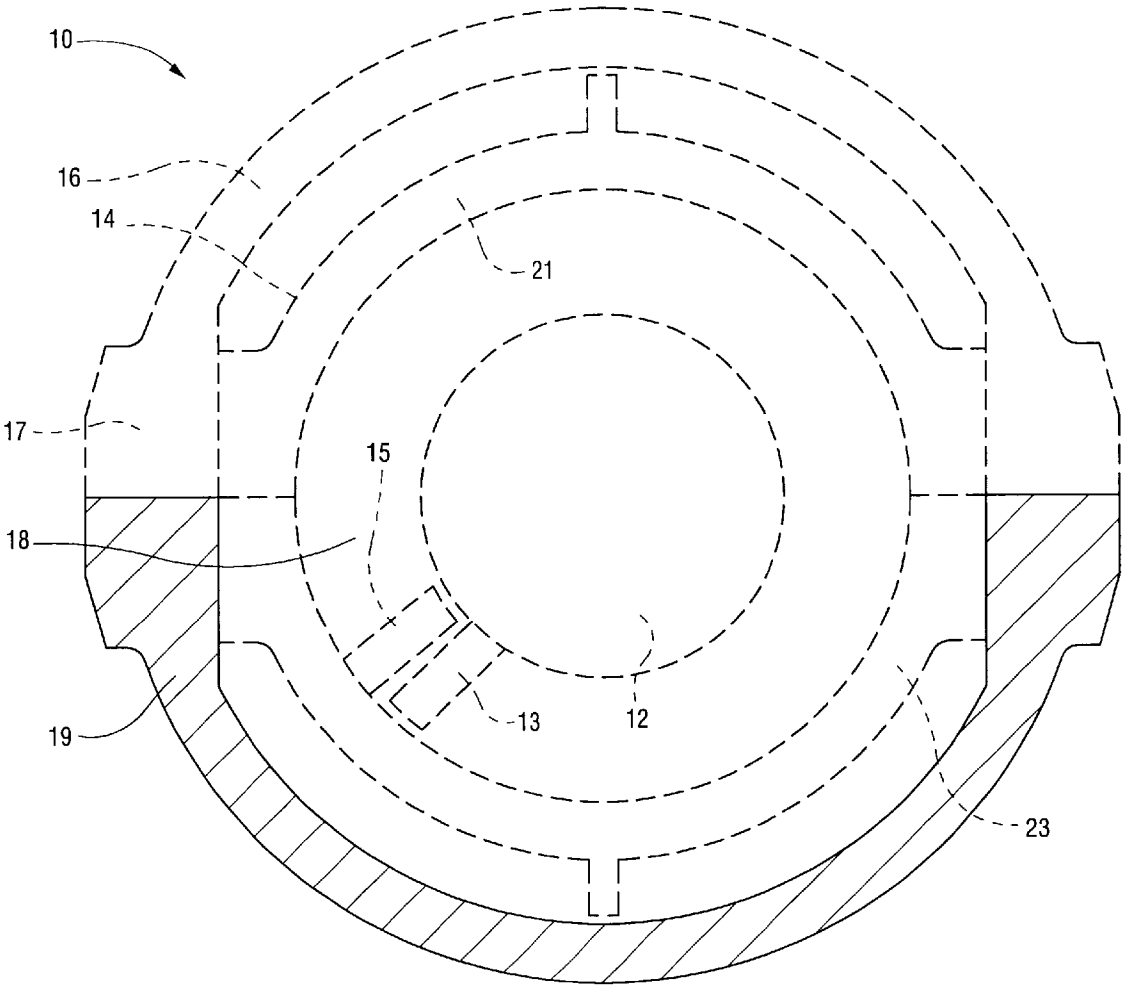
FIG. 2 is a transverse cross-sectional view through the steam turbine of FIG. 1 illustrating parts thereof in dashed lines removed from the turbine to facilitate retrofit of the steam turbine of FIG. 1 according to a preferred embodiment of the present invention.

Referring now to the drawings, particularly FIGS. 1 and 2, there is illustrated a steam turbine generally designated 10 including a rotor 12 mounting turbine blades or buckets 13, an inner shell 14 carrying stator blades 15 and an outer shell 16 including upper and lower outer shell halves 17 and 19, respectively (FIG. 2). Steam turbine 10 is of the double flow type wherein the steam flow through radial inlet ports changes into generally axial flow and flows in opposite directions along the steam path as indicated by the arrows 18. The steam turbine 10 is of a reaction stage type having a drum rotor type construction as schematically illustrated. Generally reaction type steam turbine stages have a substantial radial length from the root diameter of the blades to the outer tips of the blades in comparison with a similar dimension for an impulse stage turbine design. It will be appreciated that the rotor is formed of a solid integral elongated shaft which extends along opposite turbine sections of the double flow turbine, for example, opposite first and second turbine sections illustrated at 22 and 24. Additionally, the inner shell 14 is comprised of an upper inner shell half 21 and a lower inner shell half 23 (FIG. 2) typically bolted together. Further, the outer shell 16 is typically comprised of an upper outer shell half and a lower outer shell half fully encompassing the inner shell with the shell halves being bolted one to the other.

As will be appreciated, a steam path is defined as including a rotor, the rotor blades and an inner shell carrying stator vanes. Accordingly, the steam path 26 of the reaction-type turbine illustrated in FIG. 1 includes the rotor 12, buckets 13, inner shell 14 and stator blades 15. It has been found desirable to retrofit the steam turbine 10 (the reaction-stage type) with a new improved steam path design primarily of an impulse type but which also has an increased reaction stage. This improved steam path is of a substantially reduced diameter in comparison with the steam path of the prior art reaction steam turbine illustrated in FIG. 1. The combination of the root diameter and blade length to its tip provides a steam path diameter much less than the steam path diameter of the prior art turbine, e.g. on the order of about 50%. As noted previously, to retrofit the steam turbine 10 with a smaller diameter steam path would require a radial enlargement of the inner shell to bridge the gap between the outer shell and the steam path. Dimensional and design differences in the steam paths have resulted in an inner shell of much smaller outside diameter than the inner diameter of the outer shell. A thick inner shell design to bridge the gap between the outer shell of the prior steam turbine and its steam path would result in excessive thermal stresses during warm up and cool down of the steam path.

According to a preferred embodiment of the present invention. A spacer or carrier is provided between the inner shell and the outer shell. The spacer or carrier enables axial and radial positioning to be maintained while maintaining inner shell thickness to a minimum required by the steam path of the improved substantially impulse steam turbine design.

Figure 9:
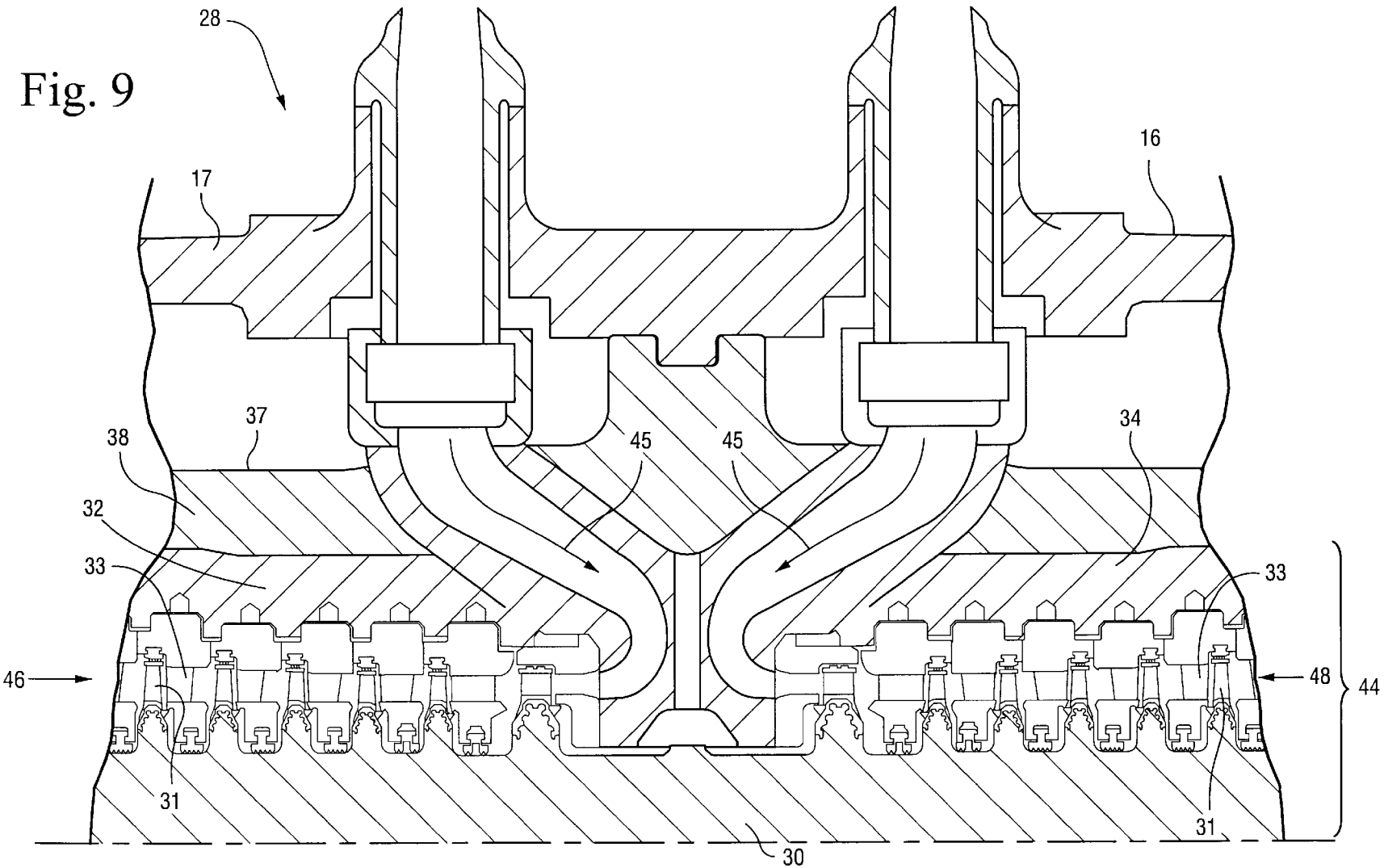
FIG. 9 is a view similar to FIG. 1 illustrating the retrofitted steam turbine.

Referring to FIG. 9 which illustrates a retrofitted turbine, generally designated 28, utilizing the improved steam path there is provided a turbine design which maintains a reasonable thickness of the inner shell of the improved steam path while enabling the steam path to be retrofitted into the outer shell 16 of the prior steam turbine 10. Generally, the improved turbine design includes a rotor 30 mounting rotor blades or buckets 31, an inner shell 32 comprised of upper and lower inner shell halves 34 and 36 and mounting stator blades 33, a carrier section or structural bridging member 37 including at least a pair of upper and lower carrier section halves 38 and 40 respectively and an outer shell comprised of the outer shell 16 of the prior art turbine 10 including upper and lower shell halves 17 and 19, respectively. A retrofitted turbine 28 includes the improved steam path generally designated 44, including rotor 30, rotor blades or buckets 31, inner shell 32 and the stator blades 33. The retrofitted steam turbine 28 may be of the double flow type wherein the steam flows in opposite directions, as illustrated by the arrows 45, through first and second turbine sections 46 and 48 respectively, although the present invention may be utilized in types of turbines other than double flow turbines.

To retrofit the steam turbine 10 with the steam path 44, reference is made to FIGS. 2–8. In FIG. 2, the steam turbine 10 is illustrated in a transverse cross-sectional view illustrating the method of replacing the steam path 26 with steam path 44. The upper outer shell half 17 of the outer shell 16 of the prior steam turbine 10 is initially removed. Next the upper inner shell half 21 of the inner shell 14 is removed.

By removing the upper, outer and inner shell halves, the rotor 12 is exposed and is removed from the turbine. The lower inner shell half 23 is then removed from the lower outer shell half 19. The removed parts are illustrated in FIG. 2 by the dashed lines leaving the lower outer shell half 19 as a starting point for insertion of the steam path 44.

Figure 3:
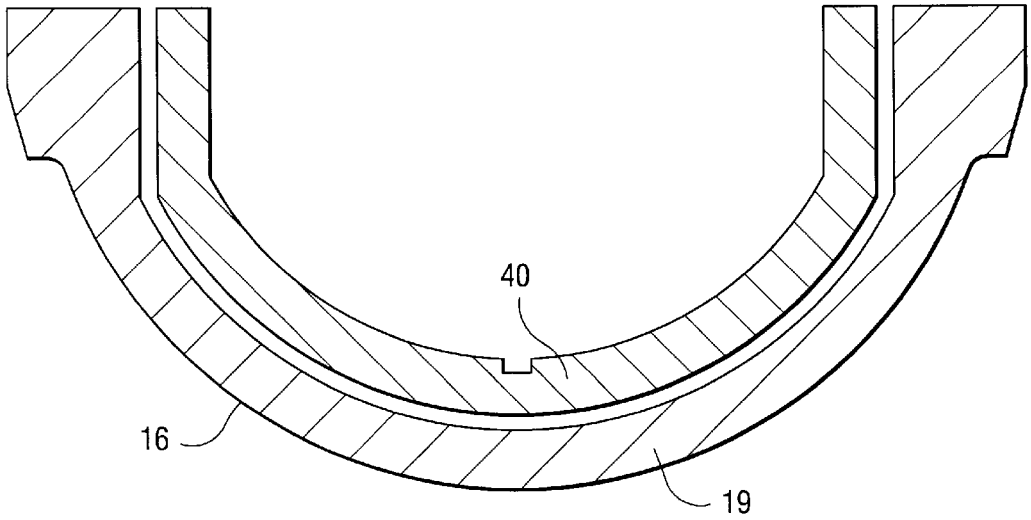
FIGS. 3–8 illustrate various steps in retrofitting the steam turbine of FIG. 1.
Figure 4:
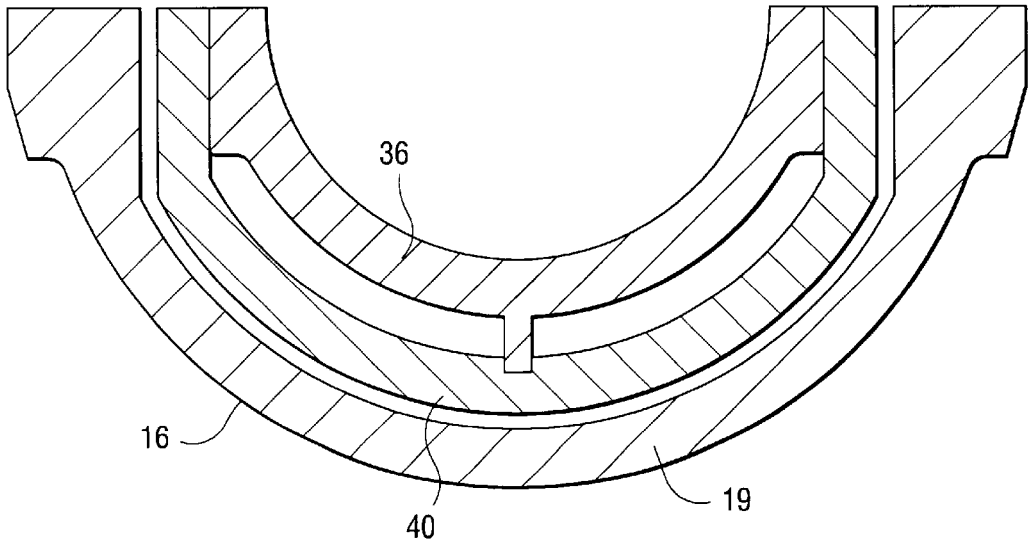
Figure 5:
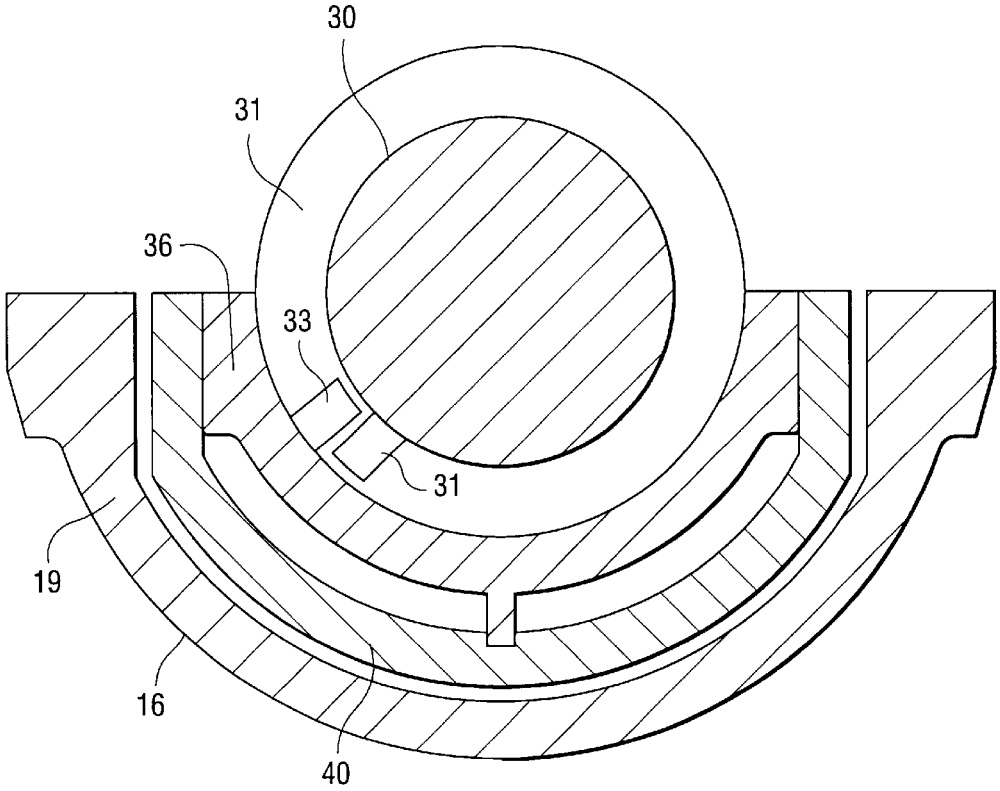
Figure 6:
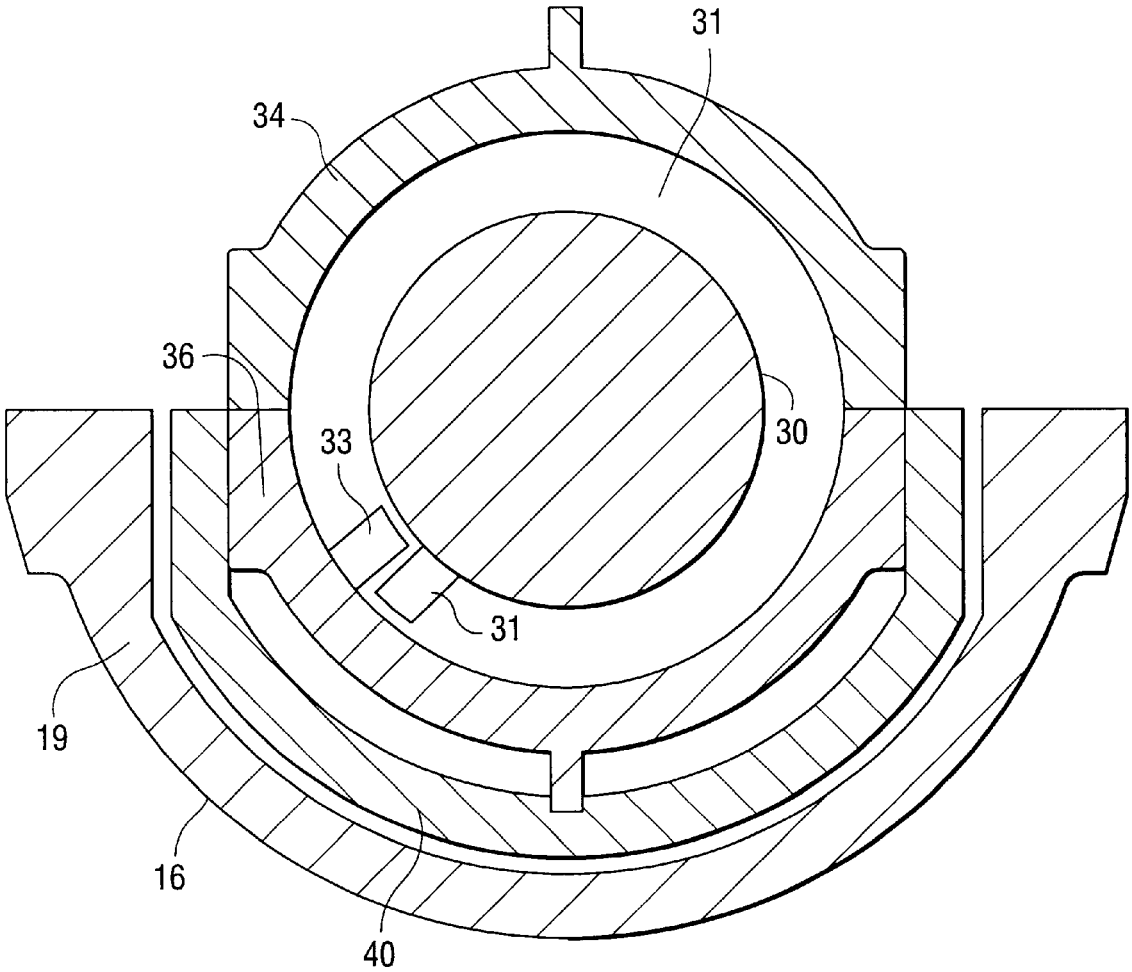
Figure 7:
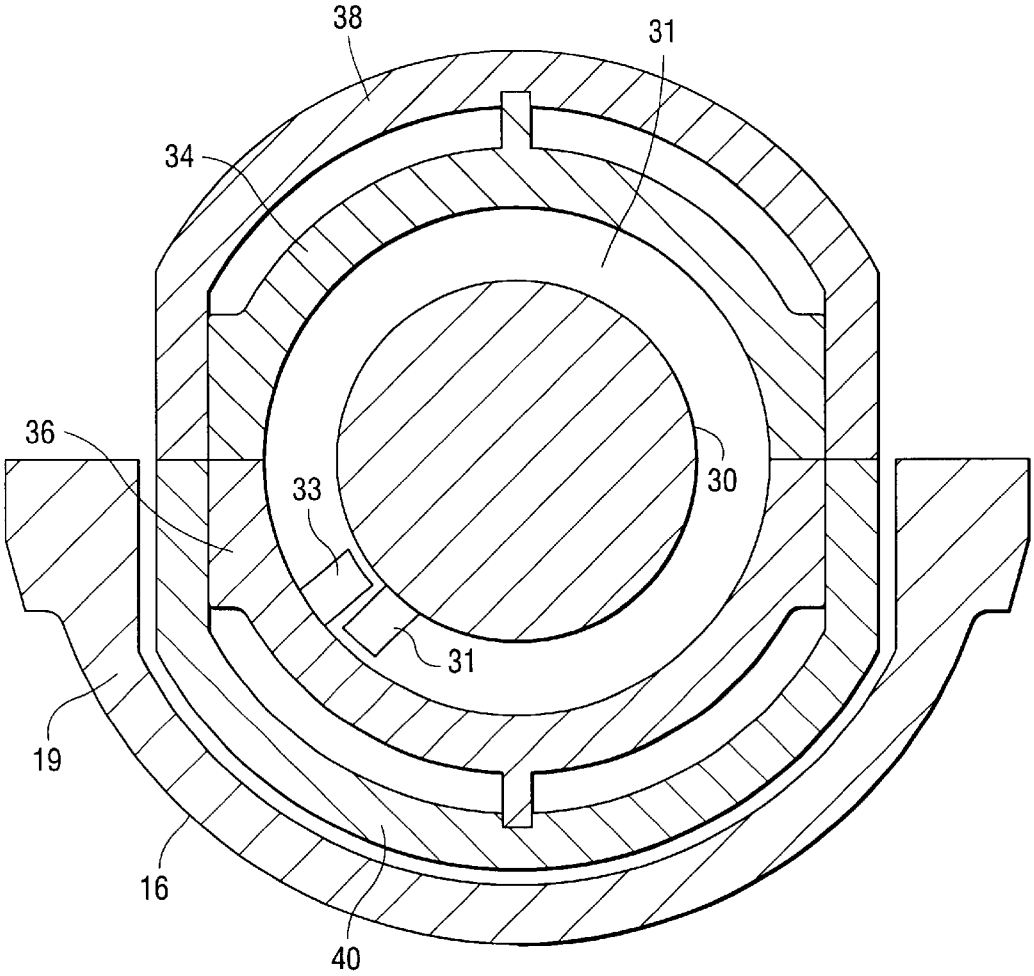
Figure 8:
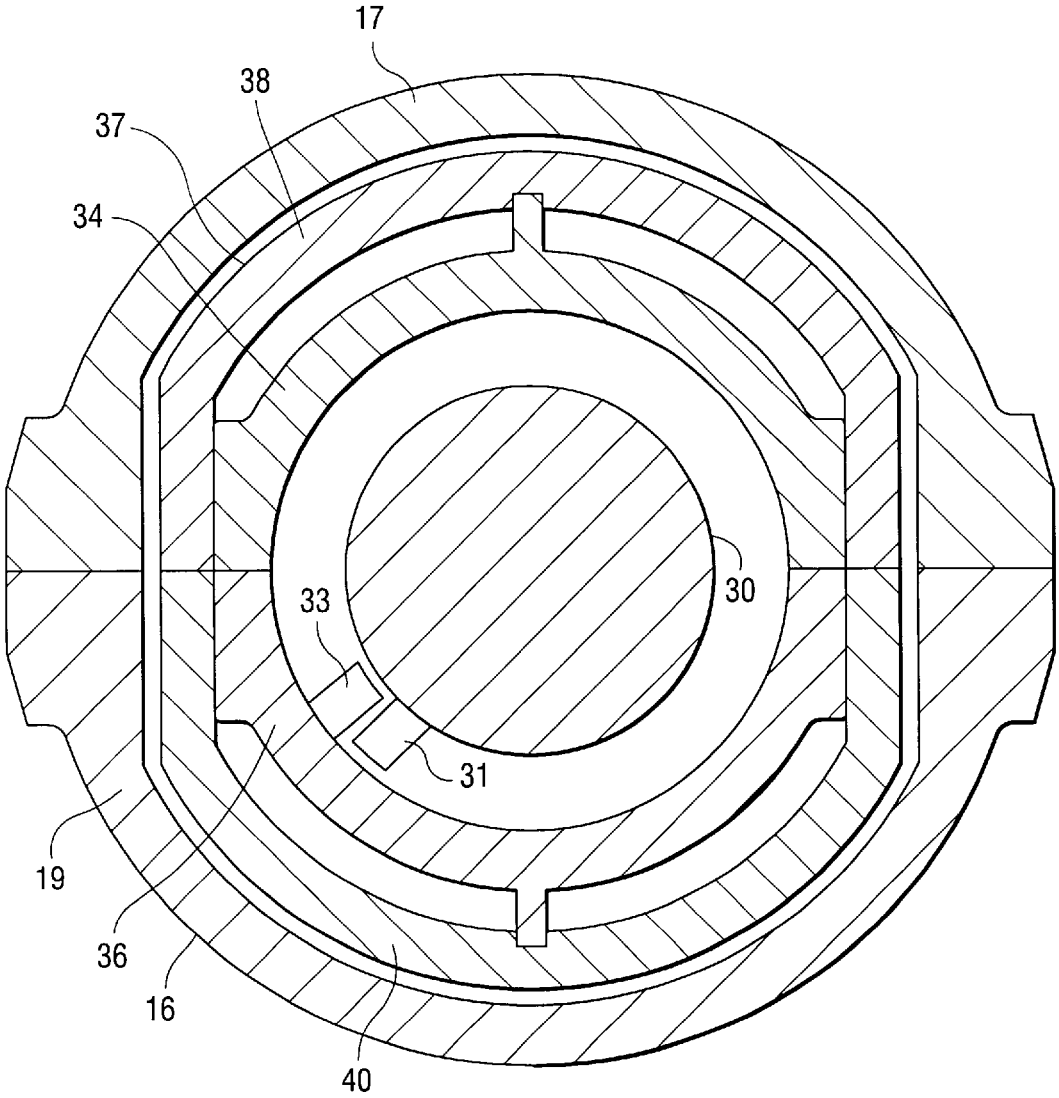
Figure 10:
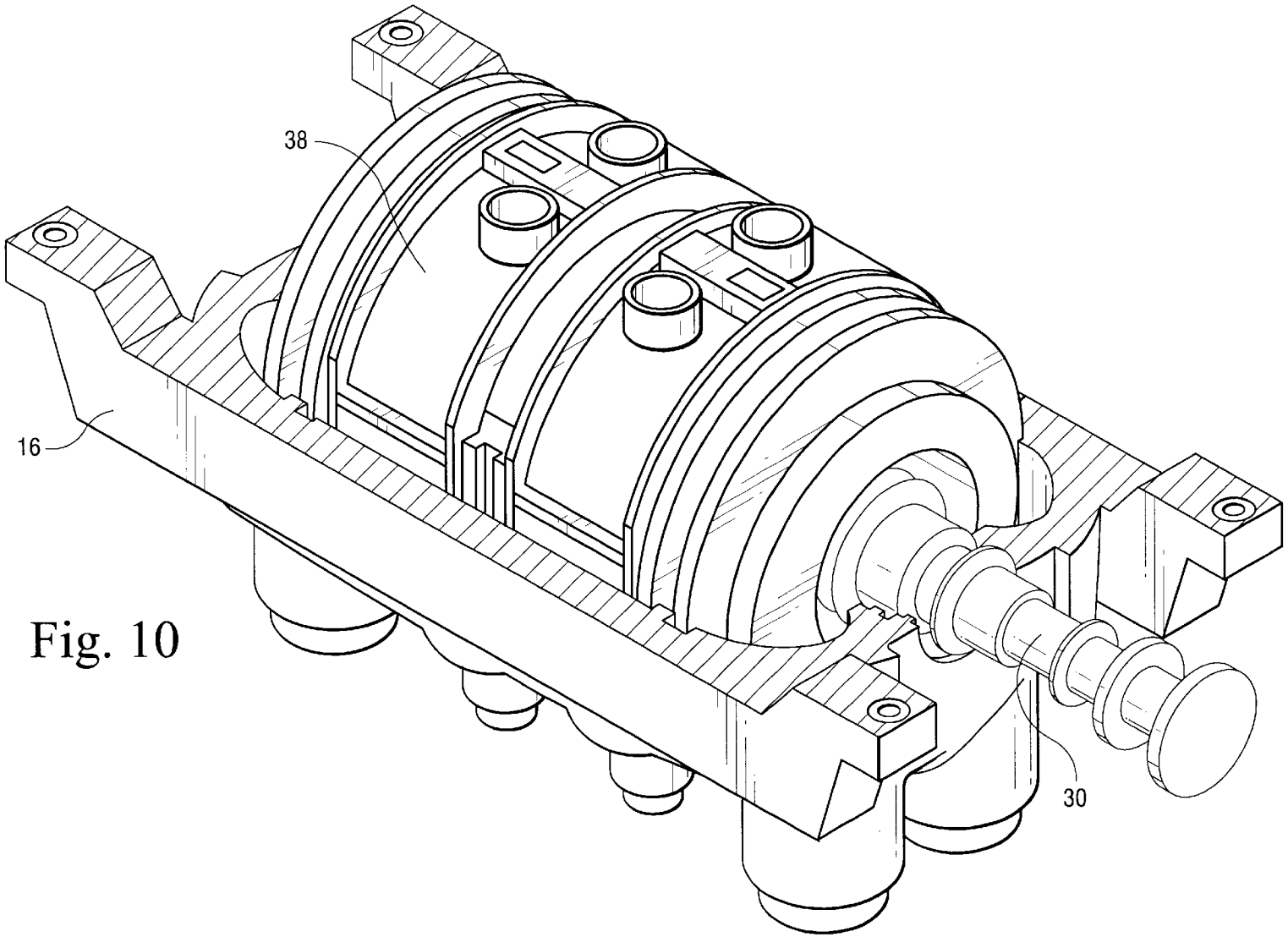
FIG. 10 is a perspective view with the upper outer shell removed of a retrofitted steam turbine according to the present invention.

To install the new steam path 44, the lower inner carrier section 40 is disposed in the lower outer shell half 19 of the turbine 10 as illustrated in FIG. 3. In the illustrated instance, since the retrofitted turbine will be of the same double flow type as the original turbine 10, two lower carrier sections 40 are disposed in the lower outer shell 19 of the turbine 10 at axially spaced positions axially corresponding generally to the axial location of the first and second turbine sections 22 and 24 of the turbine 10. Next, the lower inner shell half 36 including stator blades 33 of the steam path 44 is lowered into the lower carrier sections 40 as illustrated in FIG. 4. The rotor 30, as illustrated in FIG. 5, of the steam path 44 is then lowered into the assembly. After alignment of the rotor and other maintenance in preparation for final assembly, the upper inner shell half 34 is assembled onto the lower shell half 36 by bolting the shell halves to one another as illustrated in FIG. 6. Two carrier upper halves 38 are then assembled about the upper inner shell half 34 and bolted to the lower carrier halves 36 to form a rigid assembly. Positioning keys, not shown, are used to locate the inner shell 32 relative to the carrier sections 38 and 40 and the carrier sections to the outer shell 16. The upper outer shell half 17 of the steam turbine 10 is then assembled and bolted to the lower outer shell half 19 as illustrated in FIG. 8. Consequently, the carrier sections 38 and 40 form an interface between the internal diameter of the outer shell 16 of the prior steam turbine 10 and the outer diameter of the inner shell 32 forming part of the steam path 44. The retrofitted turbine is in part illustrated in FIG. 10 but with the upper outer shell removed for illustrative purposes.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of retrofitting a first steam turbine having an outer shell including a pair of upper and lower outer shell halves and a first steam path of a first diameter in part defined by a first inner shell and a first rotor, to provide a retrofitted second steam turbine, comprising the steps of:

(a) removing the upper outer shell half, the first inner shell and the first rotor from the lower outer shell half of the first turbine;

(b) inserting a lower carrier section into the lower outer shell half;

(c) providing a second rotor and a second inner shell in part defining a second steam path of a second diameter smaller than the first diameter of said first steam path;

(d) disposing a lower inner shell half of said second inner shell within the lower carrier section;

(e) disposing said second rotor into the lower inner shell half of said second inner shell;

(f) disposing an upper inner shell half of said second inner shell about the second rotor;

(g) disposing an upper carrier section about the upper inner shell half of the second inner shell; and (h) securing the upper outer shell half to the lower outer shell half of the first turbine thereby providing a retrofitted second steam turbine having a reduced diameter second steam path.

2. A method according to claim 1 including securing said upper inner shell half and said lower inner shell half of said second inner shell to one another.

3. A method according to claim 1 wherein said upper and lower carrier sections comprise carrier section halves, respectively, and including securing said upper carrier section half and said lower carrier section half to one another.

4. A method according to claim 1 wherein the first turbine comprises a double-flow steam path having a central steam inlet for flow in opposite axial directions through removable first and second discrete, axially spaced, turbine sections of the first turbine, wherein step (b) includes inserting discrete, lower carrier sections into the lower outer shell half at axially spaced locations therealong generally corresponding to the axial locations of the removed first and second discrete turbine sections, and step (g) includes disposing discrete, axially spaced upper carrier sections about the upper inner shell half of the second inner shell in registration with the lower carrier sections.

5. A method according to claim 1 including performing steps (a), (b), (d), (e), (f), (g), (h) sequentially.

6. A method of retrofitting a first steam turbine having a first steam path of a substantially reaction stage design to provide a second turbine having a second steam path of a substantially impulse stage design comprising the steps of:

(a) removing an upper outer shell half of the outer shell of the first turbine;

(b) removing a first inner shell and a first rotor forming part of the first steam path of the substantially reaction stage first turbine from a lower outer shell half of the outer shell of the first turbine design; and (c) placing in the lower outer shell half of the first turbine a steam path having the impulse stage design of the second turbine including a second inner shell, a second rotor, and a carrier section;

(d) securing the upper outer shell half to the lower outer shell half with said carrier section being located between the second inner shell and the outer shell of the first turbine to bridge a gap therebetween thereby providing a retrofitted second steam turbine having the second steam path of reduced diameter relative to the diameter of the first steam path.

7. A method according to claim 6 wherein the second inner shell includes upper and lower shell halves and the carrier section includes upper and lower carrier section halves, including the steps of inserting the lower carrier section half into the lower half of said outer shell, disposing the lower inner shell half within the lower carrier section half, and thereafter installing the second rotor in the turbine.

8. A method according to claim 7 including, after the second rotor has been installed, disposing the upper inner shell half of the second inner shell about the second rotor, disposing the upper carrier section half about the upper inner shell half of the second inner shell, and thereafter securing the upper outer shell half of said outer shell to the lower outer shell half.

9. A method according to claim 7 including, after the second rotor has been installed, disposing the upper inner shell half of the second inner shell about the second rotor, disposing the upper carrier section half about the upper inner shell half of the second inner shell, and thereafter securing the upper outer shell half of said outer shell to the lower outer shell half.

10. A retrofitted turbine comprising:

a discrete generally annular inner shell surrounding a rotor having an axis of rotation, said rotor defining a steam path;

a discrete generally annular outer shell surrounding said inner shell and said rotor;

a discrete generally annular structural bridging member between said inner and outer shells bridging a gap between the shells, said inner and outer shells and said bridging member lying concentrically about said axis and said steam path; and said inner shell including upper and lower inner shell halves and said outer shell includes upper and lower shell halves, said bridging member including an upper carrier section half between upper inner and out shell halves and a lower carrier section half between lower inner and outer shell halves.

11. A turbine according to claim 10 wherein said turbine comprises a double-flow steam path having a central steam inlet and a pair of axially spaced turbine sections on opposite sides of said inlet, said upper carrier section half including a pair of axially spaced upper carrier halves in generally radial registration with the respective turbine sections and said lower carrier section half including a pair of axially spaced lower carrier halves in general radial registration with the respective turbine sections.

* * * * *